US009447790B2

(12) United States Patent
Nakai et al.

(10) Patent No.: US 9,447,790 B2
(45) Date of Patent: Sep. 20, 2016

(54) CROSS-FLOW FAN

(71) Applicant: DAIKIN INDUSTRIES, LTD., Osaka-shi, Osaka (JP)

(72) Inventors: Satoshi Nakai, Kusatsu (JP); Hideshi Tanaka, Kusatsu (JP); Yoshinori Kagawa, Kusatsu (JP); Kazuhiro Matsumoto, Kusatsu (JP); Kazuya Nishimura, Kusatsu (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 14/426,006

(22) PCT Filed: Aug. 29, 2013

(86) PCT No.: PCT/JP2013/073141
§ 371 (c)(1),
(2) Date: Mar. 4, 2015

(87) PCT Pub. No.: WO2014/038464
PCT Pub. Date: Mar. 13, 2014

(65) Prior Publication Data

US 2015/0252816 A1 Sep. 10, 2015

(30) Foreign Application Priority Data

Sep. 4, 2012 (JP) ..... 2012-194255

(51) Int. Cl.
*F04D 29/28* (2006.01)
*F04D 17/04* (2006.01)

(52) U.S. Cl.
CPC ..... *F04D 29/283* (2013.01); *F04D 17/04* (2013.01)

(58) Field of Classification Search
CPC .... F04D 29/26; F04D 29/281; F04D 29/283; F04D 17/04; F05D 2240/306; F05D 2250/11; F05D 2260/30
See application file for complete search history.

(56) References Cited

U.S. PATENT DOCUMENTS 3,385,511 A * 5/1968 Wentling ..... F04D 29/283 29/889.4
2010/0158689 A1* 6/2010 Nishino ..... F04D 17/04 416/213 A

FOREIGN PATENT DOCUMENTS

GB 980623 A * 1/1965 ..... F04D 29/283
GB 986222 A 3/1965
JP 39-5378 4/1964

(Continued)

OTHER PUBLICATIONS

International Search Report of corresponding PCT Application No. PCT/JP2013/073141 dated Dec. 3, 2013.

(Continued)

*Primary Examiner* — Christopher Verdier
*Assistant Examiner* — Juan G Flores
(74) *Attorney, Agent, or Firm* — Global IP Counselors

(57) ABSTRACT

A cross-flow fan includes a disc-shaped or circular annular support plate, plural blades extending in a lengthwise direction from the support plate, and an auxiliary ring. The auxiliary ring has a ring portion that is positioned on a lengthwise direction intermediate section of the plural blades and is disposed on an outside of outer ends of the plural blades, and plural connection portions that extend from the ring portion as far as spaces between adjacent blades of the plural blades and are joined to the blades in the spaces between adjacent blades.

18 Claims, 8 Drawing Sheets

(56) References Cited

FOREIGN PATENT DOCUMENTS

| | | | |
|---|---|---|---|
| JP | 51-3009 | A | 1/1976 |
| JP | 52-74105 | A | 6/1977 |
| JP | 56-136192 | U | 10/1981 |
| JP | 56-142296 | U | 10/1981 |
| JP | 3-229991 | A | 10/1991 |
| JP | 4-82393 | U | 7/1992 |
| JP | 5-87086 | A | 4/1993 |
| JP | 2004-27870 | A | 1/2004 |
| JP | 2005-315249 | A | 11/2005 |
| JP | 2007-40260 | A | 2/2007 |

OTHER PUBLICATIONS

International Preliminary Report of corresponding PCT Application No. PCT/JP2013/073141 dated Mar. 19, 2015.

European Search Report of corresponding EP Application No. 13 83 4665.5 dated Jul. 20, 2015.

* cited by examiner

CROSS-FLOW FAN

CROSS-REFERENCE TO RELATED APPLICATIONS

This U.S. National stage application claims priority under 35 U.S.C. §119(a) to Japanese Patent Application No. 2012-194255, filed in Japan on Sep. 4, 2012, the entire contents of which are hereby incorporated herein by reference.

TECHNICAL FIELD

The present invention relates to a cross-flow fan and particularly a cross-flow fan equipped with blades made of resin.

BACKGROUND ART

Cross-flow fans used, for example, in indoor units of air conditioners have two disc-shaped or circular annular support plates that are disposed on both lengthwise direction ends and plural blades that extend in the lengthwise direction and are disposed between the two support plates. Additionally, there are cases where, as described in Japanese Patent Unexamined Publication No. H05-87086, for example, a disc-shaped or circular annular intermediate plate is disposed between both support plates in order to reinforce the strength of the plural blades.

SUMMARY

Technical Problem

In this connection, it is described in Japanese Patent Unexamined Publication No. H05-87086 that, when many support plates are disposed, flow path loss increases because air friction loss ends up occurring due to the plural support plates. However, if the number of support plates is reduced in order to reduce flow path loss caused by the support plates, the strength of the cross-flow fan ends up being reduced.

It is an object of the present invention to reduce flow path loss caused by a support plate or the like without reducing the strength of a cross-flow fan.

Solution to Problem

A cross-flow fan pertaining to a first aspect of the present invention comprises: a disc-shaped or circular annular support plate; plural blades extending in a lengthwise direction from the support plate; and an auxiliary ring having a ring portion that is positioned on a lengthwise direction intermediate section of the plural blades and is disposed on the outside of outer ends of the plural blades and plural connection portions that extend from the ring portion as far as spaces between adjacent blades of the plural blades and are joined to the blades in the spaces between adjacent blades.

According to the cross-flow fan pertaining to the first aspect, the auxiliary ring is joined to the blades at the connection portions that extend only as far as the spaces between adjacent blades, and thus flow path loss is suppressed, and the circular annular ring portion bundles together the plural blades at the lengthwise direction intermediate section of the plural blades, and thus the strength of a fan block including the support plate and the plural blades is reinforced.

A cross-flow fan pertaining to a second aspect of the present invention is the cross-flow fan pertaining to the first aspect, wherein the plural connection portions of the auxiliary ring are joined to suction surfaces of the plural blades.

According to the cross-flow fan pertaining to the second aspect, the connection portions are joined to the suction surfaces of the blades, and the pressure surface sides of the blades are not used for connection, so connection portions existing on the pressure surface sides of the blades can be reduced.

A cross-flow fan pertaining to a third aspect of the present invention is the cross-flow fan of the second aspect, wherein the plural connection portions of the auxiliary ring are each formed in a substantially triangular shape projecting inward from the ring portion, and one side of each of the connection portions having the substantially triangular shape is joined to the suction surfaces of the blades.

According to the cross-flow fan pertaining to the third aspect, one side of each of the connection portions having the substantially triangular shape is joined to the suction surfaces of the blades, so the joint sections can be enlarged, and in addition the area of the connection portions on the pressure surface side of other blades becomes reduced, so flow path loss that increases due to the connection portions can be kept low.

A cross-flow fan pertaining to a fourth aspect of the present invention is the cross-flow fan of the second aspect or the third aspect, wherein the length of the sections of the auxiliary ring where the connection portions are joined to the suction surfaces of the blades is equal to or less than half of the chord length of the blades.

According to the cross-flow fan pertaining to the fourth aspect, the length of the sections where the connection portions are joined to the suction surfaces of the blades is equal to or less than half of the chord length, so the area that the connection portions occupy in the spaces between adjacent blades can be reduced and the blade surface effective area can be enlarged. In order to reduce flexure of the blades caused by centrifugal force during fan rotation or an external force, it suffices for the outer peripheral side of half of the chord length to be supported by the auxiliary ring.

A cross-flow fan pertaining to a fifth aspect of the present invention is the cross-flow fan of any of the first aspect to the fourth aspect, wherein the ring portion of the auxiliary ring is circular annular, and the radius of the inner periphery of the ring portion is equal to or greater than the distance from the central axis of the cross-flow fan to the outer ends of the blades.

According to the cross-flow fan pertaining to the fifth aspect, by making the radius of the inner periphery of the ring portion equal to or greater than the distance from the central axis to the outer ends of the blades, the flow of air on the central axis side of the inner periphery of the ring portion is no longer obstructed by the ring portion, and it becomes easier for flow path loss to be suppressed.

A cross-flow fan pertaining to a sixth aspect of the present invention is the cross-flow fan of any of the first aspect to the fifth aspect, wherein the auxiliary ring is molded integrally with the plural blades.

According to the cross-flow fan pertaining to the sixth aspect, by molding the auxiliary ring integrally with the plural blades, assembly of the auxiliary ring and the plural blades becomes unnecessary.

A cross-flow fan pertaining to a seventh aspect of the present invention is the cross-flow fan of any of the first aspect to the sixth aspect, wherein the thickness of the ring portion of the auxiliary ring becomes thinner heading from the inner peripheral side toward the outer peripheral side.

According to the cross-flow fan pertaining to the seventh aspect, the thickness of the ring portion becomes thinner heading toward the outer peripheral side, so loss caused by air flow at the auxiliary ring can be reduced.

Advantageous Effects of Invention

In the cross-flow fan pertaining to the first aspect of the present invention, the fan block of the cross-flow fan is reinforced by the auxiliary ring, so the blades can be lengthened without reducing the strength of the cross-flow fan, and flow path loss that had conventionally been caused by an intermediate plate or the like is reduced so that flow path loss of the cross-flow fan can be reduced.

In the cross-flow fan pertaining to the second aspect of the present invention, by eliminating the connection portions on the pressure surface sides of the blades, the effective area of the pressure surfaces is increased so that blowing performance can be improved, and the effect of suppressing flow path loss can be enhanced.

In the cross-flow fan pertaining to the third aspect of the present invention, because of the structure wherein one side of each of the connection portions having the triangular shape is joined to the suction surfaces of the blades, the effects of reducing flow path loss of the cross-flow fan and preventing strength from being reduced can be improved at the same time.

In the cross-flow fan pertaining to the fourth aspect of the present invention, the blades are efficiently reinforced and the area that the connection portions occupy in the spaces between adjacent blades is reduced so that flow path loss can be suppressed.

In the cross-flow fan pertaining to the fifth aspect of the present invention, by increasing the distance from the inner periphery to the outer periphery of the ring portion (the width of the ring portion), the strength of the auxiliary ring can be increased while preventing an increase in flow path loss.

In the cross-flow fan pertaining to the sixth aspect of the present invention, assembly of the auxiliary ring and the plural blades becomes unnecessary and costs can be reduced.

In the cross-flow fan pertaining to the seventh aspect of the present invention, loss caused by air flow is reduced so that blowing characteristics can be improved.

DESCRIPTION OF EMBODIMENTS

A cross-flow fan pertaining to an embodiment of the present invention will be described below taking as an example a cross-flow fan installed in an indoor unit of an air conditioning apparatus.

(1) Cross-Flow Fan in Indoor Unit

Figure 1:
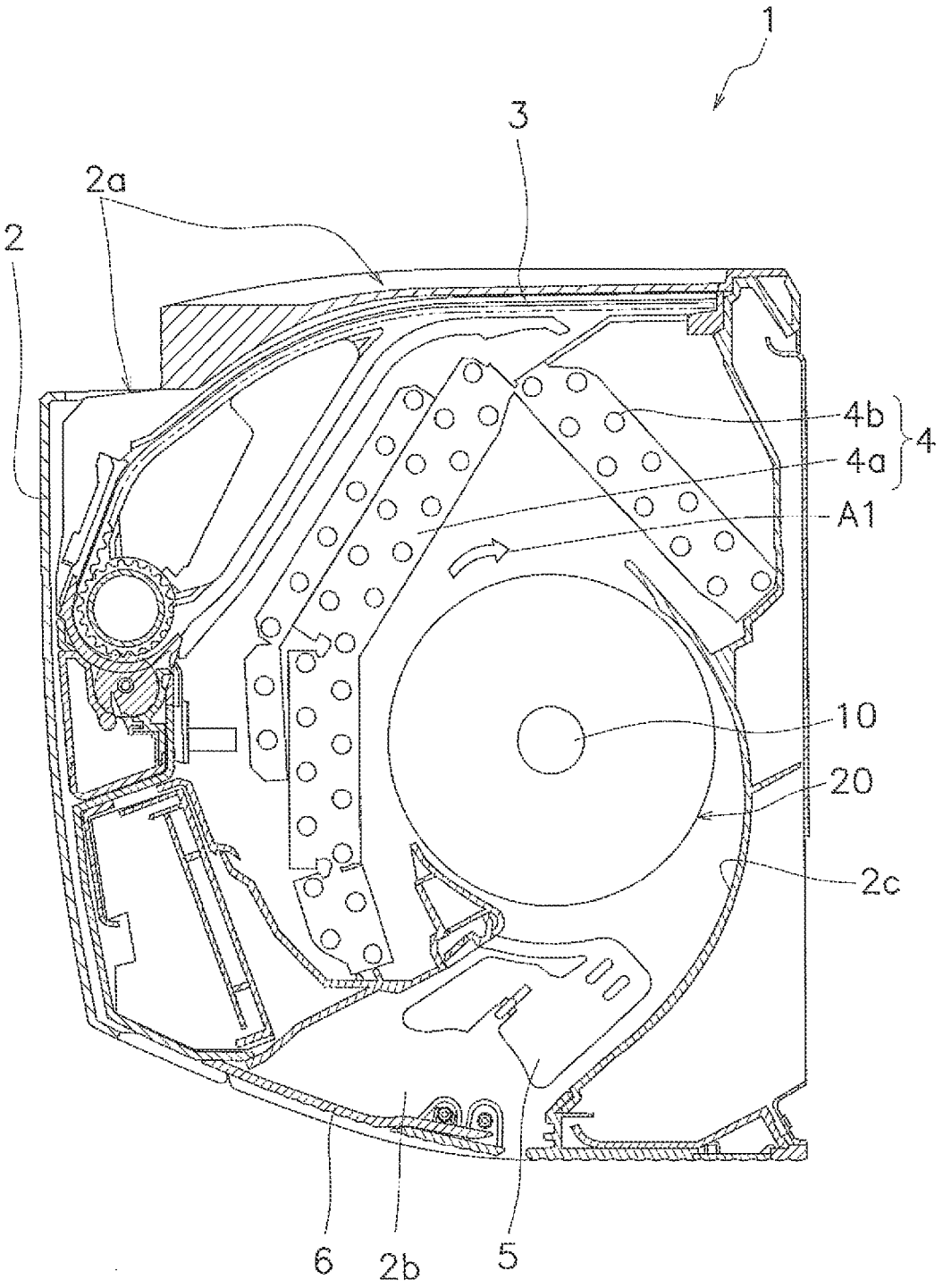
FIG. 1 is a cross-sectional view showing an overview of an indoor unit of an air conditioning apparatus.

FIG. 1 is a drawing showing an overview of a cross section of an indoor unit 1 of an air conditioning apparatus. The indoor unit 1 is equipped with a main body casing 2, an air filter 3, an indoor heat exchanger 4, a cross-flow fan 10, vertical flaps 5, and a horizontal flap 6. As shown in FIG. 1, the air filter 3 is disposed on the downstream of an air inlet 2*a* in the top surface of the main body casing 2 and opposes the air inlet 2*a*. The indoor heat exchanger 4 is disposed on the downstream of the air fitter 3. Room air that passes through the air inlet 2*a* and reaches the indoor heat exchanger 4 all passes through the air filter 3 and has dirt and dust removed from it.

The indoor heat exchanger 4 is configured as a result of a front surface side heat exchanger 4*a* and a back surface side heat exchanger 4*b* being coupled to one another so as to form an inverted V shape as seen in a side view. In a plan view seen from the top surface of the main body casing 2, the front surface side heat exchanger 4*a* is disposed in a position opposing substantially the front surface side half of the air inlet 2*a*, and the back surface side heat exchanger 4*b* is disposed in a position opposing substantially the back surface side half. Both the front surface side heat exchanger 4*a* and the back surface side heat exchanger 4*b* are configured by arranging numerous plate fins parallel to one another in the width direction of the indoor unit 1 and attaching them to heat transfer tubes. When the room air that has been sucked in from the air inlet 2*a* and passed through the air filter 3 travels between the plate fins of the front surface side heat exchanger 4*a* and the back surface side heat exchanger 4*b*, heat exchange takes places and air conditioning is performed.

On the downstream of the indoor heat exchanger 4, the substantially cylindrically shaped cross-flow fan 10 extends long along the width direction of the main body casing 2 and is disposed parallel to the width direction of the main body casing 2 together with the indoor heat exchanger 4. The cross-flow fan 10 is equipped with an impeller 20, which is disposed in a space surrounded so as to be sandwiched by the inverted V-shaped indoor heat exchanger 4, and a fan motor (not shown in the drawings) for driving the impeller 20. The cross-flow fan 10 generates an air flow as a result of the impeller 20 being rotated in direction A1 (clockwise) indicated by the arrow in FIG. 1.

An outlet passage leading to an air outlet 2*b* downstream of the cross-flow fan 10 has a back surface side configured by a scroll member 2*c*. The scroll member 2*c* has substantially the same width as the open portion of the air outlet 2*b* in the main body casing 2 as seen in a front view. The upper end of the scroll member 2*c* is positioned higher than the upper end of the cross-flow fan 10 and, as seen in a side view, is positioned in a location offset toward the back surface side of the central axis of the cylindrical cross-flow fan 10. The lower end of the scroll member 2*c* is coupled to the open end of the air outlet 2*b*. A guide surface of the scroll member 2*c* has, in order to smoothly and quietly guide to the air outlet 2*b* the air blown out from the cross-flow fan 10, a smoothly curvilinear shape having a center of curvature on the side of the cross-flow fan 10 as seen in a cross-sectional view.

(2) Schematic Structure of Impeller of Cross-Flow Fan

Figure 2:
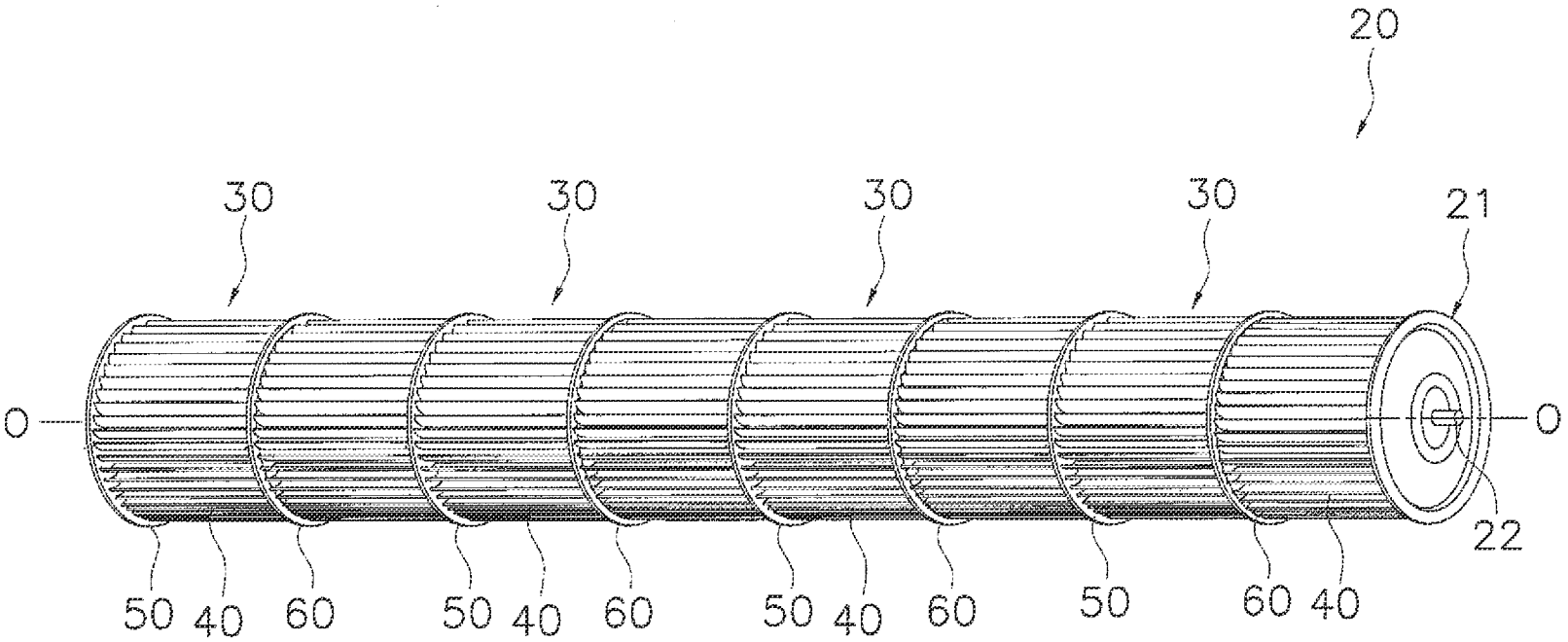
FIG. 2 is a perspective view showing an overview of an impeller of a cross-flow fan pertaining to an embodiment.

FIG. 2 shows the schematic structure of the impeller 20 of the cross-flow fan 10. The impeller 20 is, for example, configured as a result of an end plate 21 and four fan blocks 30 being joined to one another. The end plate 21 is disposed on one end of the impeller 20 and has a rotary shaft 22 made of metal on an axial center O. Additionally, ordinarily a boss portion (not shown in the drawings) that becomes connected to a fan motor shaft (not shown in the drawings) is disposed in the central portion of the fan block 30 disposed on the other end of the impeller 20. Alternatively, there are also cases where the fan block 30 disposed on the other end of the impeller 20 has another configuration, such as, for example, that fan block 30 being configured so as to have a member that combines with part of the fan motor and so as to have a metal shaft in its central portion. The rotary shaft 22 of the end plate 21 and the boss portion (or metal shaft) of the fan block 30 on the other end of the impeller 20 are supported so that the impeller 20 rotates about the axial center O. For the end plate 21, one that is the same as what has conventionally been used is used. However, in order to apply the present invention, it is not necessary for the structure of the end plate 21 to be one that is the same as what has conventionally been used, and the structure of the end plate 21 can be appropriately changed.

Figure 3:
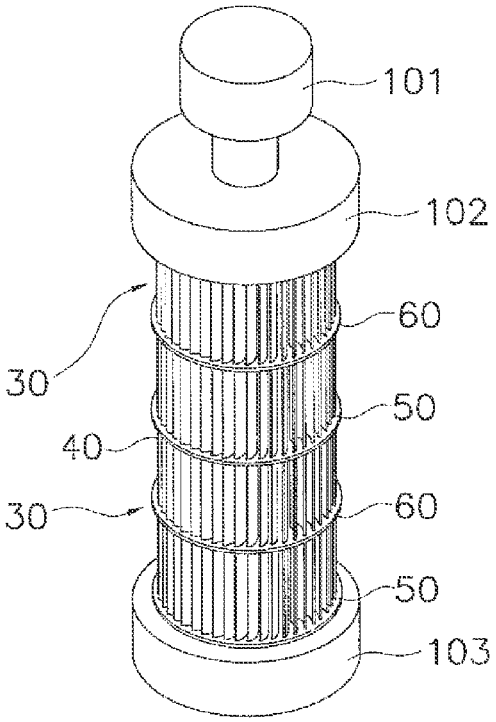
FIG. 3 is a perspective view for describing a step in the assembly of the impeller of the cross-flow fan.
Figure 4:
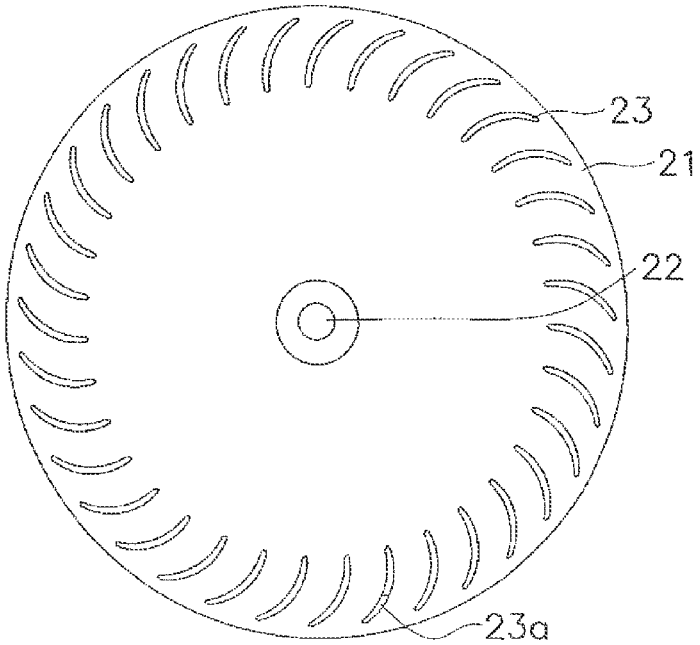
FIG. 4 is a plan view showing an example of the configuration of an end plate of the impeller.

Each fan block 30 is equipped with plural blades 40, a circular annular support plate 50, and an auxiliary ring 60. In the assembly of the impeller 20, the plural blades 40 of one fan block 30 are fused to the support plate 50 of an adjacent fan block 30 or the end plate 21. FIG. 3 shows a step in which two mutually adjacent fan blocks 30 are fused to one another. The two fan blocks 30 are set on top of one another on a jig 103. The fan blocks 30 placed on top of one another are sandwiched by the jig 103 and a horn 102. Ultrasonic waves are supplied to the horn 102 from an oscillator 101, and the supplied ultrasonic waves travel through the horn 102 and are applied to the fan blocks 30. Because of that, the blades 40 of one fan block 30 and the support plate 50 of the other fan block 30 are fused to one another by the ultrasonic waves. In the same way, a fan block 30 and the end plate 21 are sandwiched between another jig and the horn 102 and ultrasonic waves are supplied by the oscillator 101 to the horn 102, so that the blades 40 of the fan block 30 and the end plate 21 are fused to one another. As shown in FIG. 4, a number of recessed portions 23 equal to the number of the blades 40 are formed in the end plate 21 in order to position the blades 40 on the end plate 21 during this fusing. The recessed portions 23 each have a planar shape slightly larger than the cross-sectional shape of the blades 40, so the blades 40 fit into and are fitted together with the recessed portions 23. Among the plural recessed portions 23, there is just one recessed portion 23 in which a step portion 23*a* is formed in order to position the end plate 21 and the fan block 30.

(3) Detailed Configuration of Fan Block

Figure 5:
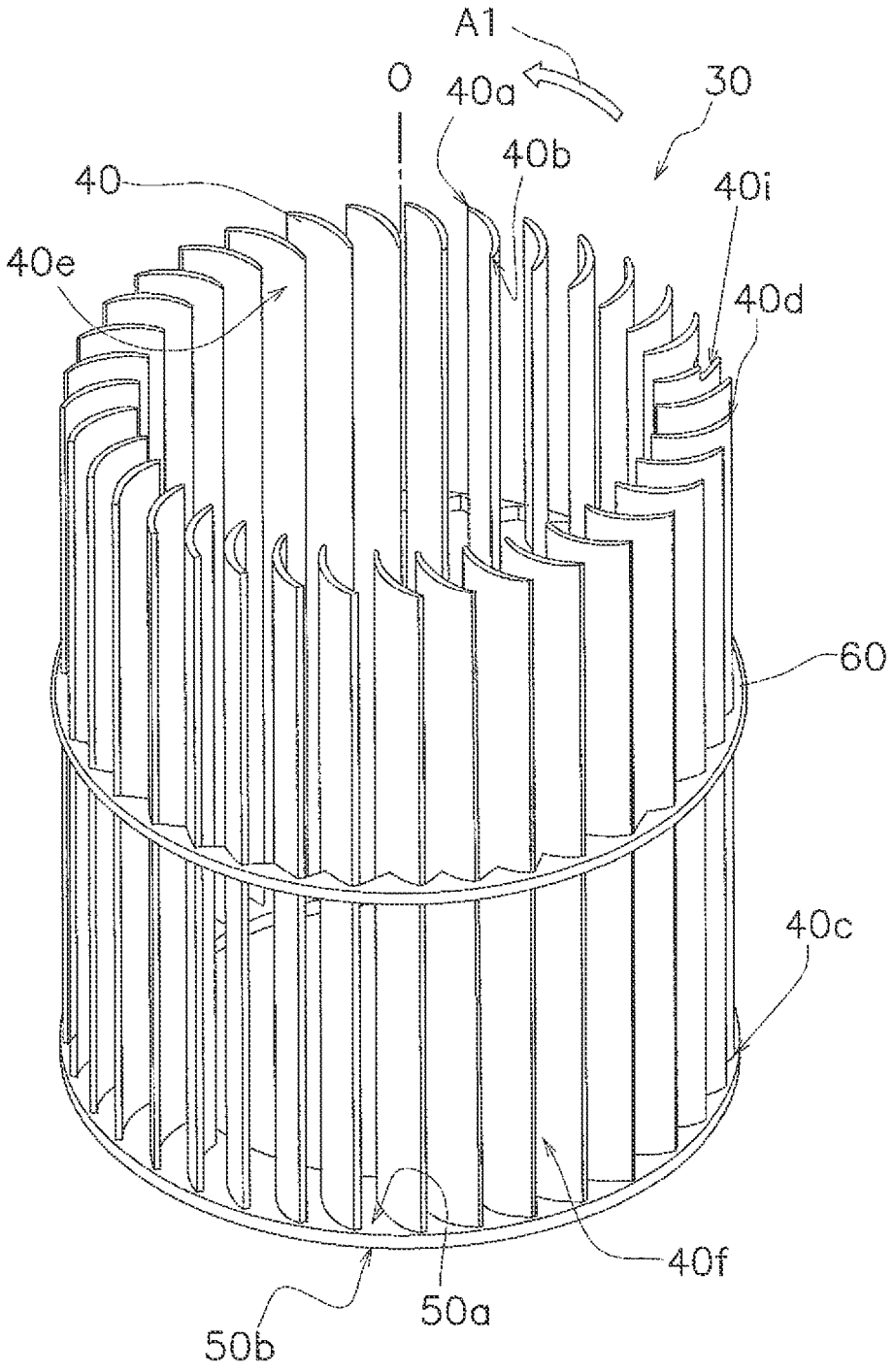
FIG. 5 is a perspective view showing an example of the configuration of a fan block of the impeller.
Figure 6:
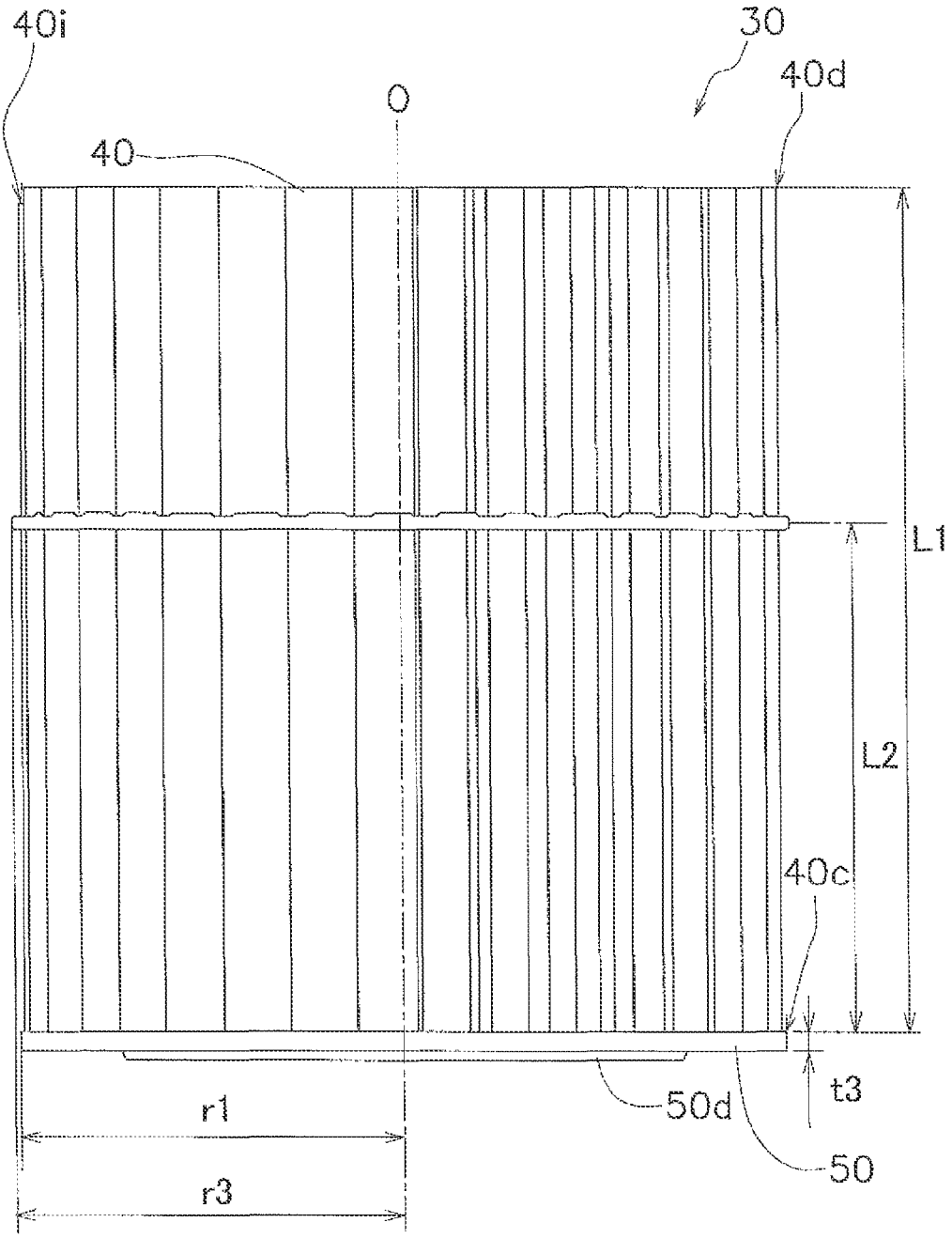
FIG. 6 is a side view showing an example of the configuration of the fan block of the impeller.

FIG. 5 to FIG. 10 show the detailed configuration of the fan blocks 30 pertaining to the present embodiment. FIG. 5 is a perspective view showing one of the plural fan blocks 30 configuring the impeller 20 shown in FIG. 2, and FIG. 6 is a side view of that fan block 30. The fan block 30 shown in FIG. 5 and FIG. 6 comprises plural blades 40, a support plate 50, and an auxiliary ring 60 that are integrally molded by injection molding, for example, using a thermoplastic resin as their main material. The rotational direction of the fan block 30 is direction A1 indicated by the arrow in FIG. 5.

(3-1) Blades

The plural blades 40 extend in the lengthwise direction (the direction along the axial center O) from a first surface 50*a* of the circular annular support plate 50. The blades 40 are molded integrally with the support plate 50, and thus blade base portions 40*c* are fixed to the first surface 50*a* of the support plate 50 and the sides of the blades 40 opposite the blade base portions 40*c* in the lengthwise direction become blade distal end portions 40*d*. A length L1 of the blades 40 (the dimension from the blade base portions 40*c* to the blade distal end portions 40*d*) is, for example, about 10 cm. The blades 40 have suction surfaces 40*f* and pressure surfaces 40*e*. When the fan block 30 rotates in direction A1 indicated by the arrow in FIG. 5, the pressure on the side of the pressure surfaces 40*e* of the blades 40 becomes higher and the pressure on the side of the suction surfaces 40*f* becomes lower.

Among the plural blades 40, there is just one blade 40 having a cutaway portion 40*i* formed in the blade distal end portion 40*d*. The cutaway portion 40*i* is for positioning two fan blocks 30 or a fan block 30 and the end plate 21, and is a section that fits together with the step portion 23*a* of the recessed portion 23 of the end plate 21 described above or a step portion 51*c* of a recessed portion 51 of the fan block 30 described later. Because there is the cutaway portion 40*i*, the blades 40 and the recessed portions 23 of the end plate 21 or the recessed portions 51 of the fan block 30 can be made to have a one-to-one correspondence with one another in this way. When this positioning is done, the plural blades 40 can be made to correspond by group to plural split molds of a mold at the time of injection molding and the blades 40 can be disposed in such a way that they are easily removed from the split molds. Specifically, the plural blades 40 are disposed in a shape having rotational asymmetry in which the inclination of the blades 40 is changed in the direction in which the blades 40 are removed from the split molds to make them easier to remove compared to a case where the plural blades 40 are disposed so as to have rotational symmetry relative to the axial center O.

(3-2) Support Plate

Figure 7:
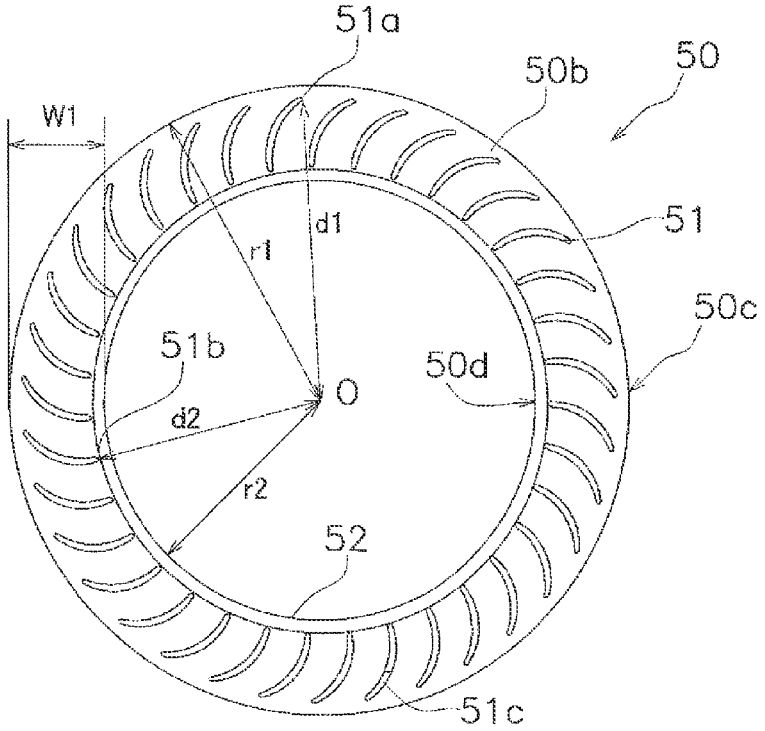
FIG. 7 is a plan view showing an example of the configuration of a support plate of the fan block.

FIG. 7 shows a state in which the circular annular support plate 50 is seen from its bottom surface, that is, a state in which the circular annular support plate 50 is seen from the side of a second surface 50*b*. Recessed portions 51 into which the blades 40 fit are formed in the second surface 50*b*, which is opposite the first surface 50*a* of the support plate 50. The recessed portions 51 each have a planar shape slightly larger than the cross-sectional shape of the blades 40, so when two fan blocks 30 are placed on top of one another, the blades 40 fit into and are fitted together with the recessed portions 51. A ring-shaped raised portion 52 higher than the second surface 5*b* is formed along the inner periphery of the support plate 50. The outer peripheral side of the raised portion 52 is slanted off of the horizontal plane, and the raised portion 52 fulfills the role of guiding the blades 40 to the recessed portions 51 when two fan blocks 30 are placed on top of one another.

An outer periphery 51*a* of the recessed portions 51 that outer ends 40*a* of the blades 40 touch is located on the inside of an outer periphery 50*c* of the support plate 50, and inner ends 51*b* of the recessed portions 51 that inner ends 40*b* of the blades 40 touch are located on the outside of an inner periphery 50*d* of the support plate 50. In other words, a distance d1 from the center (a point on the axial center O) of the support plate 50 to the outer periphery 51*a* of the recessed portions 51 (the distance to the outer ends 40*a* of the blades 40) is smaller than a radius r1 from the center of the support plate 50 to the outer periphery 50*c*. Furthermore, a distance d2 from the center (a point on the axial center O) of the support plate 50 to the inner ends 51*b* of the recessed portions 51 (the distance to the inner ends 40*b* of the blades 40) is larger than a radius r2 from the center of the support plate 50 to the inner periphery 50*d*. In order to keep high the strength with which the support plate 50 supports the blades 40, a width W1 (radius r1−radius r2) of the support plate 50 is set larger than the radial direction distance (distance d1−distance d2) from the outer ends 40*a* of the blades 40 to the inner ends 40*b*.

(3-3) Auxiliary Ring

The auxiliary ring 60 is positioned on the lengthwise direction intermediate section of the blades 40 and is located in a position away from the blade base portions 40*c* by a distance of 60% of the dimension from the blade base portions 40*c* to the blade distal end portions 40*d* (the length L1 of the blades 40). It is preferred that the position where the auxiliary ring 60 is disposed be away from the blade base portions 40*c* by a distance equal to or greater than 55% of the length L1 in order to improve the strength of the cross-flow fan 10 and facilitate the assembly step such as ultrasonic welding. However, it is not necessary for the position where the auxiliary ring 60 is disposed to be away from the blade base portions 40*c* by a distance equal to or greater than 55% of the length L1, and it suffices for the auxiliary ring 60 to be positioned on the lengthwise direction intermediate section of the blades 40. As will be understood from the above description, a configuration where the auxiliary ring 60 is located in a position a little offset from the exact middle is also included in the concept of the lengthwise direction intermediate section of the blades 40.

Figure 8:
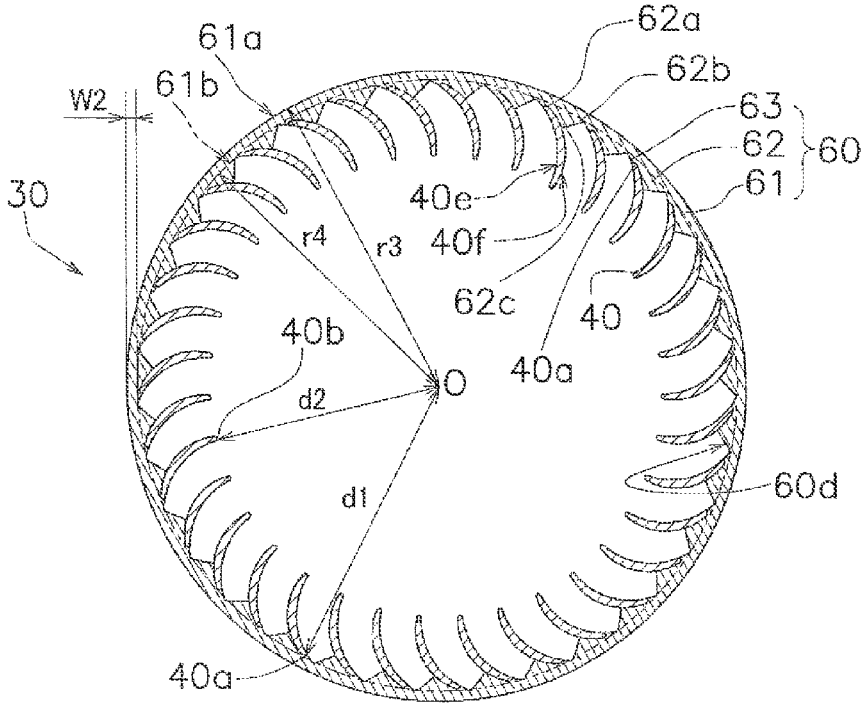
FIG. 8 is a cross-sectional view showing an example of the configuration of an auxiliary ring of the fan block.
Figure 9:
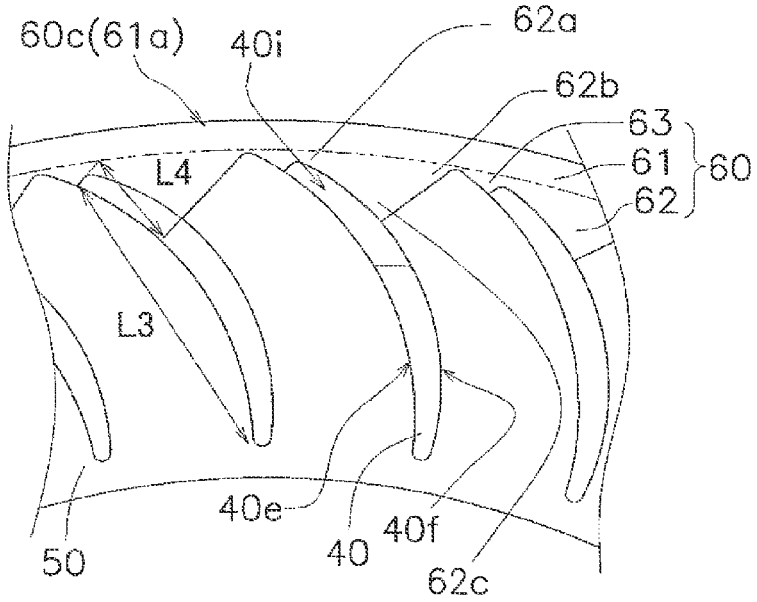
FIG. 9 is a partially enlarged plan view for describing the configuration of the fan block shown in FIG. 5.

FIG. 8 shows the cross-sectional shape of the section where the auxiliary ring 60 and the blades 40 are joined to one another. The cross section shown in FIG. 8 is a cross section that appears when the auxiliary ring 60 and the blades 40 are cut by a plane perpendicular to the axial center O. In FIG. 9, the auxiliary ring 60, the blades 40, and the support plate 50 when looking from the blade distal end portions 40*d* of the blades 40 toward the blade base portions 40*c* are shown partially enlarged. The auxiliary ring 60 mainly comprises a ring portion 61, connection portions 62, and connection auxiliary portions 63. A radius r3 of an outer periphery 61*a* of the ring portion 61 is larger than the radius r1 of the outer periphery 51*a* of the support plate 50. Furthermore, the radius r3 of the outer periphery 61*a* of the ring portion 61 is larger than the distance d1 from the center (a point on the axial center O) of the auxiliary ring 60 to the outer ends 40*a* of the blades 40. That is, the outer periphery 61*a* of the ring portion 61 runs along the outside of the outer ends 40*a* of all the blades 40. A radius r4 of an inner periphery 61*b* of the ring portion 61 of the auxiliary ring 60 is larger than the radius r2 of the inner periphery 51*b* of the support plate 50 and is slightly larger than the distance d1 to the outer ends 40*a* of the blades 40, and the inner periphery 61*b* of the ring portion 61 runs along the neighborhood of the outside of the outer ends 40*a* of the blades 40.

The connection portions 62 are each formed in a triangular shape projecting inward from the ring portion 61 as seen in the direction of the axial center O. The connection portions 62 having the triangular shape each have three vertex portions 62*a*, 62*b*, and 62*c*; the sides between the vertex portions 62*a* and 62*b* are connected to the ring portion 61, and the sides between the vertex portions 62*a* and 62*c* are connected to the suction surfaces 40*f* of the blades 40. The connection portions 62 are not connected to the pressure surfaces 40*e* of the blades 40. A length L4 of the sections where the connection portions 62 are connected to the suction surfaces 40*f* (the length from the vertex portions 62*a* to the vertex portions 62*c* is equal to or shorter than ½ of a chord length L3. By setting the length L4 of the sections connected to the suction surfaces 40*f* equal to or shorter than ½ of the chord length L3, blowing characteristics are improved compared to a case where the length L4 is set longer than ½ of the chord length L3.

The connection auxiliary portions 63 are firmed in the neighborhoods of the outer ends 40*a* of the blades 40. The connection auxiliary portions 63 are sections filling in the spaces between the outer ends 40*a* of the blades 40, the connection portions 62, and the ring portion 61, and aid the connection of these three.

Figure 10:
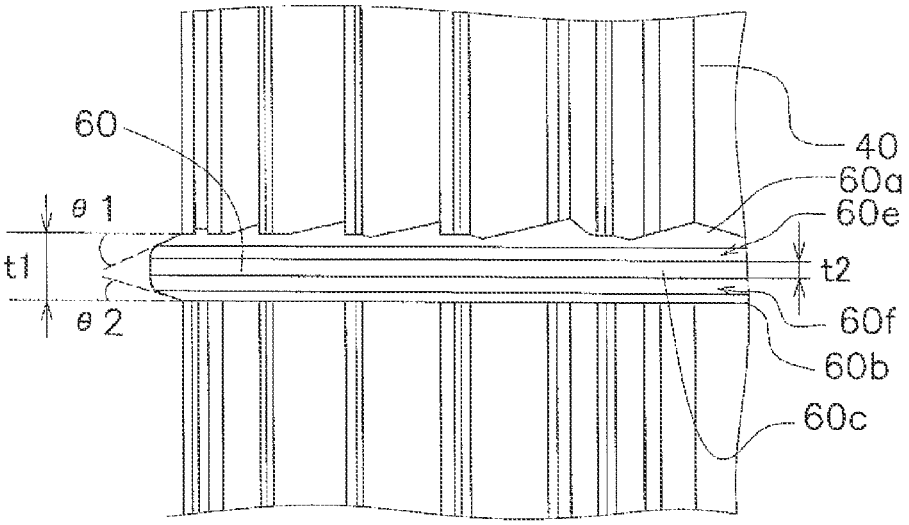
FIG. 10 is a partially enlarged side view for describing the configuration of the fan block shown in FIG. 6.

In FIG. 10, part of the auxiliary ring 60 as seen from the side is shown enlarged. The auxiliary ring 60 has a first surface 60*a* on the side of the blade distal end portions 40*d*, a second surface 60*b* on the side of the blade base portions 40*c*, an outer peripheral surface 60*c*, and an inner peripheral surface 60*d*. A curved surface 60*e* having a radius of curvature R1 is formed in the section interconnecting the first surface 60*a* and the outer peripheral surface 60*c*, and a curved surface 60*f* having a radius of curvature R2 is for in the section interconnecting the second surface 60*b* and the outer peripheral surface 60*c*.

The thickness of the auxiliary ring 60 becomes thinner heading from the inner peripheral side toward the outer peripheral side. In other words, a thickness t2 of the auxiliary ring 60 at the outer peripheral surface 60*c* is smaller than a thickness t1 of the auxiliary ring 60 in the neighborhood of the blade base portions 40*c*. Seen in greater detail, an angle of inclination θ1 with which the first surface 60*a* of the auxiliary ring 60 intersects a plane perpendicular to the axial center O is set so as to be larger than an angle of inclination θ2 with which the second surface 60*b* intersects this perpendicular plane. It will be noted that the thickness t1 of the auxiliary ring 60 is set smaller than a thickness t3 of the support plate 50.

(4) Example Modifications (4-1)

In the above-described embodiment, a case was described where one auxiliary ring 60 is disposed on one fan block 30, but plural auxiliary rings 60 may also be disposed on one fan block 30.

(4-2)

In the above-described embodiment, a case was described where the radius r3 of the outer periphery 61*a* of the ring portion 61 is larger than the radius r1 of the outer periphery 51*a* of the circular annular support plate 50, but the radius r3 of the outer periphery 61*a* of the ring portion 61 may also be set the same as the radius r1 of the outer periphery 51*a* of the support plate 50.

(4-3)

In the above-described embodiment, a case was described where the radius r4 of the inner periphery 61*b* of the ring portion 61 is slightly larger than the distance d1 to the outer ends 40*a* of the blades 40, but the radius r4 may also be configured to be equal to the distance d1 so that the inner periphery 61*b* of the ring portion 61 runs along the outer ends 40*a* of the blades 40.

(4-4)

In the above-described embodiment, a case was described where the shape of the auxiliary ring 60 is circular annular, but the shape of the auxiliary ring 60 is not limited to being circular annular and may also, for example, be a polygonal shape having the same number of corners as the number of blades 40 or a shape having serrations (numerous indentations) in the outer peripheral end.

(5) Characteristics (5-1)

As described above, the ring portion 61 of the auxiliary ring 60 is positioned on the lengthwise direction intermediate section of the plural blades 40 and is disposed on the outside of the outer ends 40*a* of the plural blades 40. Furthermore, the plural connection portions 62 of the auxiliary ring 60 extend from the ring portion 61 as far as spaces between adjacent blades of the plural blades 40 and are joined to the blades 40 in the spaces between adjacent blades. The "spaces between adjacent blades" means, in other words, each region sandwiched between the pressure surface 40*e* of one blade 40 of the plural blades 40 and the suction surface 40*f* of the blade 40 adjacent to that blade 40.

The auxiliary ring 60 is joined to the blades 40 at the connection portions 62 that extend only as far as the spaces between adjacent blades, and thus flow path loss is suppressed. At the same time, the circular annular ring portion 61 bundles together the plural blades 40 at the lengthwise direction intermediate section of the plural blades 40, and thus the strength of the fan block 30 including the circular annular support plate 50 and the plural blades 40 is reinforced.

Figure 11:
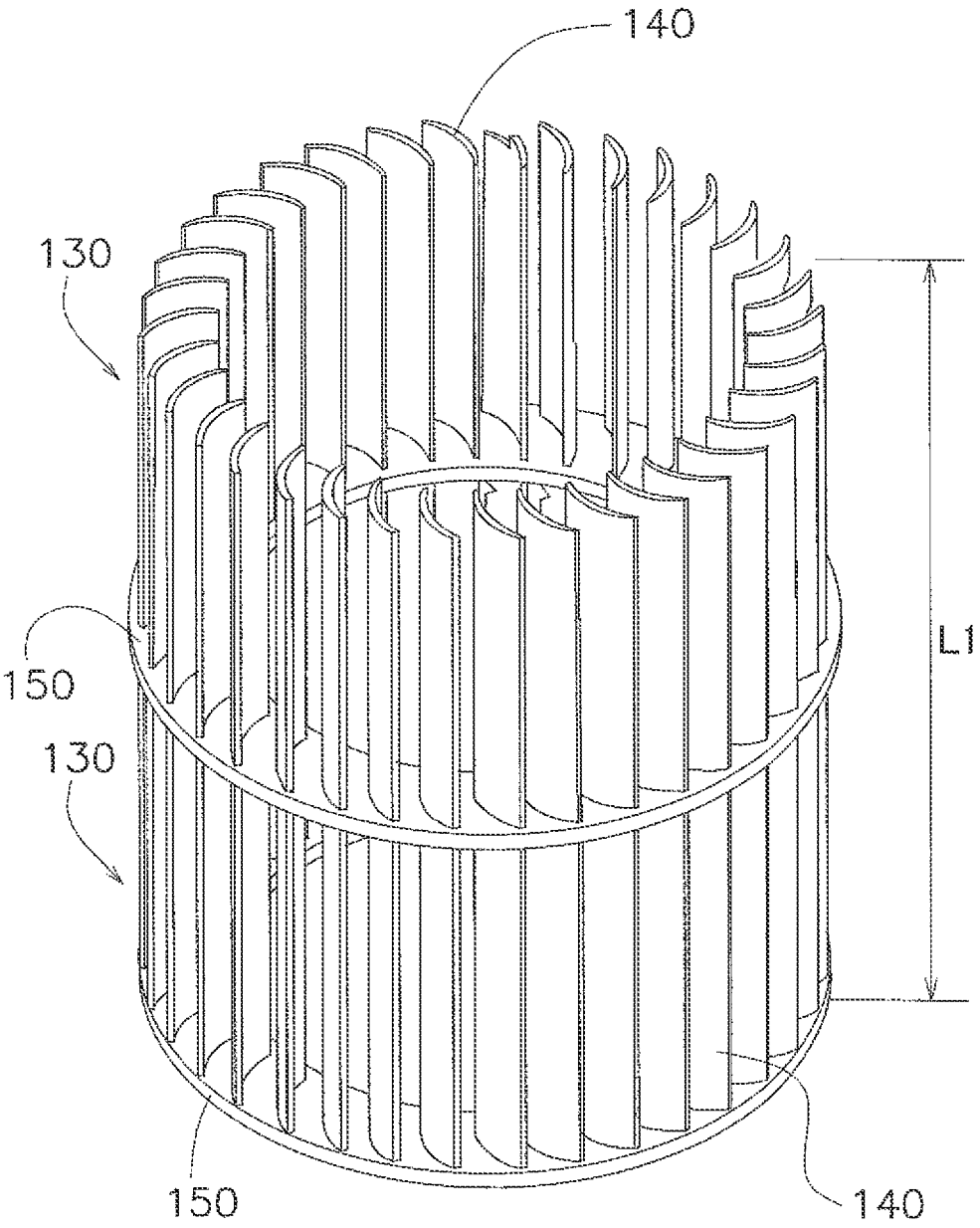
FIG. 11 is a perspective view showing the configuration of another fan block contrasted with the fan block of FIG. 5.

A configuration will be considered where, for example, in order to obtain a block resembling the fan block 30 having the length L1, instead of the auxiliary ring 60, as shown in FIG. 11, two fan blocks 130 whose blades 140 are relatively short are joined to one another by a circular annular support plate 150. Here, the structure of the support plate 150 is the same as that of the support plate 50 described above. Comparing the two fan blocks 130 of FIG. 11 with the one fan block 30 of FIG. 5, their strength when configuring an impeller is substantially the same, but in the configuration of FIG. 11 the flow path loss of the two fan blocks 130 increases compared to the case of the auxiliary ring 60 because the support plate 150 is positioned in the middle of the blocks. Moreover, in the configuration of FIG. 11, an increase in costs relating to assembly is also conceivable because there is an added step for joining the two fan blocks 130 to one another.

It will be noted that, although in the above-described embodiment a case was described where the support plate 50 is circular annular, even if the support plate is disc-shaped it can be formed in the same way as in a case where it is circular annular, and even in a case where a disc-shaped support plate is used, effects that are the same as those in a case where the circular annular support plate 50 is used are achieved.

(5-2)

In the cross-flow fan 10, the connection portions 62 are joined to the suction surfaces 40*f* of the blades 40 and are not joined to the pressure surfaces 40*e* of the blades 40. Even when there is the auxiliary ring 60, as the connection portions 62 do not exist on the pressure surfaces 40*e* of the blades 40 in this way, loss on the side of the pressure surfaces 40*e* is reduced, so the effect of suppressing flow path loss can be enhanced more than reducing loss on the side of the suction surfaces 40*f* where pressure is small.

(5-3)

Furthermore, the connection portions 62 are each formed in a triangular shape projecting inward from the ring portion 61. Additionally, one side (the side between the vertex portion 62*a* and the vertex portion 62*c*) of each of the connection portions 62 having the triangular shape is joined to the suction surfaces 40*f* of the blades 40. Because one side of each of the connection portions 62 having the triangular shape is joined to the suction surfaces 40*f* of the blades 40, the joint sections can be enlarged relative to the area of the connection portions 62. In addition, one of the vertices lies on the pressure surface side of other blades, on flow path loss that increases due to the connection portions can be kept low. Because of this structure, the effects of reducing flow path loss of the cross-flow fan 10 and preventing strength from being reduced can be improved at the same time. The sides of the connection portions 60 between the vertex portions 62*a*, 62*b*, and 62*c* are substantially linear, but each side may also be somewhat irregular.

(5-4)

As shown in FIG. 9, the length L4 of the sections of the auxiliary ring 60 where the connection portions 62 are joined to the suction surfaces 40*f* of the blades 40 is equal to or less than half of the chord length L3 of the blades 40. For that reason, the area that the connection portions 62 occupy in the spaces between adjacent blades becomes smaller so that flow path loss is suppressed.

(5-5)

By making the radius r4 of the inner periphery of the ring portion 61 equal to or greater than the distance d1 from the axial center O of the central axis of the cross-flow fan 10 to the outer ends 40*a* of the blades 40, the flow of air on the central axis side of the inner periphery of the ring portion 61 is no longer obstructed by the ring portion 61. Because of that, it becomes easier for flow path loss to be controlled, and the strength of the auxiliary ring 60 can be increased by increasing the distance from the inner periphery of the ring portion 61 to the outer periphery (the width W2 of the ring portion).

(5-6)

In the cross-flow fan 10 described above, the auxiliary ring 60 and the plural blades 40 are formed of resin, and the auxiliary ring 60 is molded integrally with the plural blades 40 by injection molding, for example. By molding the auxiliary ring 60 integrally with the plural blades, assembly of the auxiliary ring and the plural blades becomes unnecessary and costs can be reduced. Likewise, the support plate 50 is also funned of resin and is molded integrally with the auxiliary ring 60 and the plural blades 40 by injection molding, for example, at the same time as the plural blades 40 and the auxiliary ring 60. For that reason, the effect of reducing costs resulting from reducing the number of assembly steps becomes even greater.

(5-7)

Furthermore, the thickness of the ring portion 61 of the auxiliary ring 60 becomes thinner heading from the inner peripheral side toward the outer peripheral side. In other words, the thickness t1 on the inner peripheral side is larger than the thickness t2 on the outer peripheral side. For that reason, loss caused by air flow at the auxiliary ring 60 can be reduced and blowing characteristics can be improved. Furthermore, it is preferred that the thickness of the auxiliary ring 60 become thinner heading toward the outer peripheral side from the connection portions 62 to the ring portion 61. In this case also, blowing characteristics can be further improved. Moreover, because the thickness of the auxiliary ring 60 is thinner on the outer peripheral side than it is on the inner peripheral side, it becomes easier to remove the fan block 30 of the cross-flow fan 10 from the mold during injection molding.

What is claimed is:

1. A cross-flow fan comprising:

a disc-shaped or circular annular support plate, plural blades extending in a lengthwise direction from the support plate; and an auxiliary ring having a ring portion positioned on a lengthwise direction intermediate section of the plural blades and being disposed on an outside of outer ends of the plural blades, and plural connection portions extending from the ring portion as far as spaces between adjacent blades of the plural blades and being joined to the blades in the spaces between adjacent blades, the plural connection portions of the auxiliary ring being joined to suction surfaces of the plural blades and are not joined to pressure surfaces of the plural blades, and the connection portions extending radially inwardly from the ring portion to an inner peripheral surface of the auxiliary ring that is disposed radially outwardly of radially inner most ends of the plural blades.

2. The cross-flow fan according to claim 1, wherein the auxiliary ring has a circular outer periphery.

3. The cross-flow fan according to claim 2, wherein the plural connection portions of the auxiliary ring are each formed in a substantially triangular shape projecting inward from the ring portion, and one side of each of the connection portions having the substantially triangular shape is joined to the suction surfaces of the blades.

4. The cross-flow fan according to claim 3, wherein the auxiliary ring extends as far as portions of spaces between adjacent blades of the plural blades and is joined to the blades in the portions of the spaces between adjacent blades.

5. The cross-flow fan according to claim 2, wherein the ring portion of the auxiliary ring is circular annular, and a radius of a circular inner periphery of the ring portion is equal to or greater than a distance from a central axis of the cross-flow fan to the outer ends of the blades.

6. The cross-flow fan according to claim 5, wherein the auxiliary ring is molded integrally with the plural blades.

7. The cross-flow fan according to claim 2, wherein a thickness of the ring portion of the auxiliary ring becomes thinner heading from an inner peripheral side toward an outer peripheral side.

8. The cross-flow fan according to claim 1, wherein the plural connection portions of the auxiliary ring are each formed in a substantially triangular shape projecting inward from the ring portion, and one side of each of the connection portions having the substantially triangular shape is joined to the suction surfaces of the blades.

9. The cross-flow fan according to claim 1, wherein the auxiliary ring extends as far as portions of spaces between adjacent blades of the plural blades and is joined to the blades in the portions of the spaces between adjacent blades.

10. The cross-flow fan according to claim 1, wherein the ring portion of the auxiliary ring is circular annular, and a radius of a circular inner periphery of the ring portion is equal to or greater than a distance from a central axis of the cross-flow fan to the outer ends of the blades.

11. The cross-flow fan according to claim 1, wherein the auxiliary ring is molded integrally with the plural blades.

12. The cross-flow fan according to claim 1, wherein a thickness of the ring portion of the auxiliary ring becomes thinner heading from an inner peripheral side toward an outer peripheral side.

13. A cross-flow fan comprising:

a disc-shaped or circular annular support plate;

plural blades extending in a lengthwise direction from the support plate; and an auxiliary ring having a ring portion positioned on a lengthwise direction intermediate section of the plural blades and being disposed on an outside of outer ends of the plural blades, and plural connection portions extending from the ring portion as far as spaces between adjacent blades of the plural blades and being joined to the blades in the spaces between adjacent blades, the plural connection portions of the auxiliary ring being joined to suction surfaces of the plural blades and are not joined to pressure surfaces of the plural blades, the auxiliary ring extending as far as portions of spaces between adjacent blades of the plural blades and being joined to the blades in the portions of the spaces between adjacent blades, and a length of the sections of the auxiliary ring where the connection portions are joined to the suction surfaces of the blades being equal to or less than half of a chord length of the blades.

14. The cross-flow fan according to claim 13, wherein the auxiliary ring has a circular outer periphery, and the plural connection portions of the auxiliary ring are each formed in a substantially triangular shape projecting inward from the ring portion, and one side of each of the connection portions having the substantially triangular shape is joined to the suction surfaces of the blades.

15. A cross-flow fan comprising:

a disc-shaped or circular annular support plate;

plural blades extending in a lengthwise direction from the support plate; and an auxiliary ring having a ring portion having a continuous annular configuration on a lengthwise direction intermediate section of the plural blades and being disposed on an outside of outer ends of the plural blades, and plural connection portions extending from the ring portion as far as spaces between adjacent blades of the plural blades and being joined to the blades in the spaces between adjacent blades, the auxiliary ring mainly composed of a thermoplastic resin being molded integrally with the plural blades, the support plate mainly composed of a thermoplastic resin having an outer periphery on an outside of outer ends of the plural blades being molded integrally with the plural blades, and the plural connection portions of the auxiliary ring each being formed in a substantially triangular shape projecting inward from the ring portion, the plural connection portions extending radially inwardly from the ring portion to an inner peripheral surface of the auxiliary ring that is disposed radially outwardly of radially inner most ends of the plural blades such that one side of each of the connection portions having the substantially triangular shape is joined to only a portion of each of the suction surfaces of the blades.

16. The cross-flow fan according to claim 15, wherein the ring portion of the auxiliary ring is circular annular, and a radius of an inner periphery of the ring portion is equal to or greater than a distance from a central axis of the cross-flow fan to the outer ends of the blades.

17. The cross-flow fan according to claim 15, wherein a thickness of the ring portion of the auxiliary ring becomes thinner heading from an inner peripheral side toward an outer peripheral side.

18. A cross-flow fan comprising:

a disc-shaped or circular annular support plate;

plural blades extending in a lengthwise direction from the support plate; and an auxiliary ring having a ring portion having a continuous annular configuration on a lengthwise direction intermediate section of the plural blades and being disposed on an outside of outer ends of the plural blades, and plural connection portions extending from the ring portion as far as spaces between adjacent blades of the plural blades and being joined to the blades in the spaces between adjacent blades, the auxiliary ring mainly composed of a thermoplastic resin being molded integrally with the plural blades, the support plate mainly composed of a thermoplastic resin having an outer periphery on an outside of outer ends of the plural blades being molded integrally with the plural blades, the plural connection portions of the auxiliary ring each being formed in a substantially triangular shape projecting inward from the ring portion, and one side of each of the connection portions having the substantially triangular shape being joined to each of the suction surfaces of the blades, and a length of the sections of the auxiliary ring where the connection portions are joined to the suction surfaces of the blades is equal to or less than half of a chord length of the blades.

* * * * *